US007886545B2

(12) United States Patent
Lacy et al.

(10) Patent No.: US 7,886,545 B2
(45) Date of Patent: Feb. 15, 2011

(54) METHODS AND SYSTEMS TO FACILITATE REDUCING $NO_x$ EMISSIONS IN COMBUSTION SYSTEMS

(75) Inventors: Benjamin Paul Lacy, Greer, SC (US); Gilbert Otto Kraemer, Greer, SC (US); Balachandar Varatharajan, Clifton Park, NY (US); Ertan Yilmaz, Albany, NY (US); John Joseph Lipinski, Simpsonville, SC (US); Willy Steve Ziminsky, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 963 days.

(21) Appl. No.: 11/741,502

(22) Filed: Apr. 27, 2007

(65) Prior Publication Data

US 2008/0264033 A1 Oct. 30, 2008

(51) Int. Cl.
*F02C 3/06* (2006.01)
*F02C 3/14* (2006.01)

(52) U.S. Cl. ..... 60/804; 60/733; 60/746; 60/747; 60/39.37; 60/752; 60/760

(58) Field of Classification Search ..... 60/733, 60/746, 747, 39.37, 752, 760; 431/178, 179
See application file for complete search history.

(56) References Cited

U.S. PATENT DOCUMENTS

| | | | | |
|---|---|---|---|---|
| 5,623,819 | A | 4/1997 | Bowker et al. | |
| 5,688,115 | A | 11/1997 | Johnson | |
| 5,918,457 | A | 7/1999 | Dobbeling et al. | |
| 5,974,781 | A | 11/1999 | Correa et al. | |
| 6,038,861 | A | 3/2000 | Amos et al. | |
| 6,047,550 | A | 4/2000 | Beebe | |
| 6,094,916 | A | 8/2000 | Puri et al. | |
| 6,192,688 | B1 * | 2/2001 | Beebe | 60/723 |
| 6,272,840 | B1 * | 8/2001 | Crocker et al. | 60/776 |
| 6,272,863 | B1 | 8/2001 | Pfefferle et al. | |
| 6,868,676 | B1 | 3/2005 | Haynes | |

* cited by examiner

*Primary Examiner*—Michael Cuff
*Assistant Examiner*—Craig Kim
(74) *Attorney, Agent, or Firm*—Armstrong Teasdale LLP

(57) ABSTRACT

A method for assembling a gas turbine combustor system is provided. The method includes providing a combustion liner including a center axis, an outer wall, a first end, and a second end. The outer wall is orientated substantially parallel to the center axis. The method also includes coupling a transition piece to the liner second end. The transition piece includes an outer wall. The method further includes coupling a plurality of lean-direct injectors along at least one of the liner outer wall and the transition piece outer wall such that the injectors are spaced axially apart along the wall.

20 Claims, 5 Drawing Sheets

METHODS AND SYSTEMS TO FACILITATE REDUCING $NO_x$ EMISSIONS IN COMBUSTION SYSTEMS

STATEMENT REGARDING FEDERALLY SPONSORED RESEARCH & DEVELOPMENT

This invention was made with Government support under DE-FC26-05NT42643 awarded by the Department of Energy ("DOE"). The Government has certain rights in this invention

BACKGROUND OF THE INVENTION

This invention relates generally to combustion systems and more particularly, to methods and systems to facilitate reducing $NO_x$ emissions in combustion systems.

During the combustion of natural gas and liquid fuels, pollutants such as, but not limited to, carbon monoxide ("CO"), unburned hydrocarbons ("UHC"), and nitrogen oxides ("$NO_x$") emissions may be formed and emitted into an ambient atmosphere. CO and UHC are generally formed during combustion conditions with lower temperatures and/or conditions with an insufficient time to complete a reaction. In contrast, $NO_x$ is generally formed under higher temperatures. At least some known pollutant emission sources include devices such as, but not limited to, industrial boilers and furnaces, larger utility boilers and furnaces, gas turbine engines, steam generators, and other combustion systems. Because of stringent emission control standards, it is desirable to control $NO_x$ emissions by suppressing the formation of $NO_x$ emissions.

Generally, lower flame temperatures, more uniform and lean fuel-air mixtures, and/or shorter residence burning times are known to reduce the formation of $NO_x$. At least some known combustion systems implement combustion modification control technologies such as, but not limited to, Dry-Low $NO_x$ ("DLN") combustors including lean-premixed combustion and lean-direct injection concepts in attempts to reduce $NO_x$ emissions. Other known combustor systems implementing lean-premixed combustion concepts attempt to reduce $NO_x$ emissions by premixing a lean combination of fuel and air prior to channeling the mixture into a combustion zone defined within a combustion liner. A primary fuel-air premixture is generally introduced within the combustion liner at an upstream end of the combustor and a secondary fuel-air premixture may be introduced towards a downstream exhaust end of the combustor.

At least some known combustors implementing lean-direct injection concepts also introduce fuel and air directly and separately within the combustion liner at the upstream end of the combustor prior to mixing. The quality of fuel and air mixing in the combustor affects combustion performance. However, at least some known lean-direct injection combustors may experience difficulties in rapid and uniform mixing of lean-fuel and rich-air within the combustor liner. As a result, locally stoichiometric zones may be formed within the combustor liner. Local flame temperatures within such zones may exceed the minimum $NO_x$ formation threshold temperatures to enable formation of $NO_x$ emissions.

However, at least some known lean-premixed combustors may experience flame holding or flashback conditions in which a pilot flame that is intended to be confined within the combustor liner travels upstream towards the primary and/or secondary injection locations. As a result, combustor components may be damaged and/or the operability of the combustor may be compromised. Known lean-premixed combustors may also be coupled to industrial gas turbines that drive loads.

As a result, to meet the turbine demands for loads being driven, such combustors may be required to operate with peak gas temperatures that exceed minimum $NO_x$ formation threshold temperatures in the reaction zone. As such, $NO_x$ formation levels in such combustors may increase even though the combustor is operated with a lean fuel-air premixture. Moreover, known lean-premixed combustors that enable longer burning residence time at near stoichiometric temperatures may enable formation of $NO_x$ and/or other pollutant emissions.

BRIEF DESCRIPTION OF THE INVENTION

A method for assembling a gas turbine combustor system is provided. The method includes providing a combustion liner including a center axis, an outer wall, a first end, and a second end. The outer wall is orientated substantially parallel to the center axis. The method also includes coupling a transition piece to the liner second end. The transition piece includes an outer wall. The method further includes coupling a plurality of lean-direct injectors along at least one of the liner outer wall and the transition piece outer wall such that the injectors are spaced axially apart along the wall.

DETAILED DESCRIPTION OF THE INVENTION

The exemplary methods and systems described herein overcome the structural disadvantages of known Dry-Low $NO_x$ ("DLN") combustors by combining lean-premixed combustion and axially-staged lean-direct injection concepts. It should be appreciated that the term "LDI" is used herein to refer to lean-direct injectors that utilize lean-direct injection concepts. It should also be appreciated that the term "first end" is used throughout this application to refer to directions and orientations located upstream in an overall axial flow direction of combustion gases with respect to a center longitudinal axis of a combustion liner. It should be appreciated that the terms "axial" and "axially" are used throughout this application to refer to directions and orientations extending substantially parallel to a center longitudinal axis of a combustion liner. It should also be appreciated that the terms "radial" and "radially" are used throughout this application to refer to directions and orientations extending substantially perpendicular to a center longitudinal axis of the combustion liner. It should also be appreciated that the terms "upstream" and "downstream" are used throughout this application to refer to directions and orientations located in an overall axial fuel flow direction with respect to the center longitudinal axis of the combustion liner.

Figure 1:
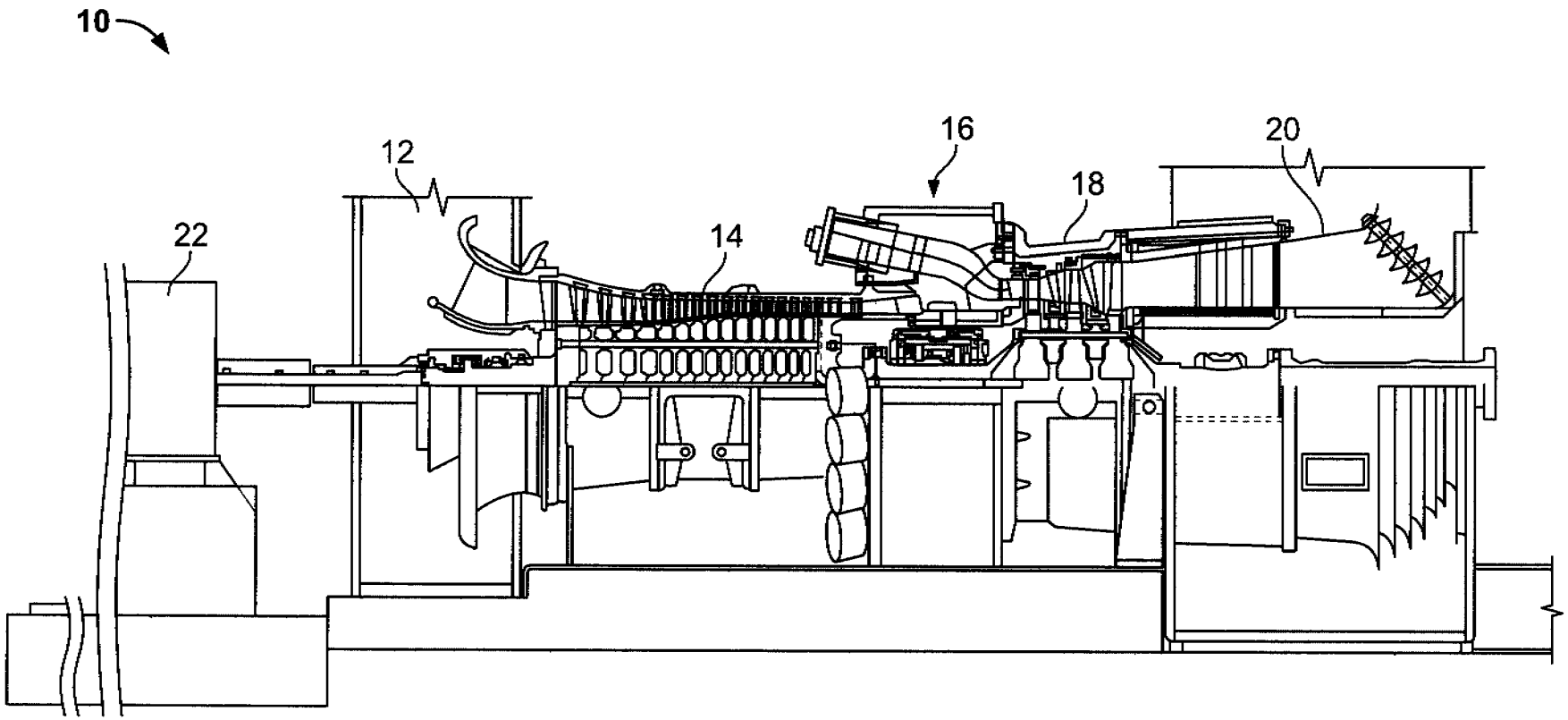
FIG. 1 is a schematic illustration of an exemplary turbine engine assembly including a combustion section.

FIG. 1 is a schematic illustration of an exemplary gas turbine system 10 including an intake section 12, a compressor section 14 coupled downstream from the intake section 12, a combustor section 16 coupled downstream from the intake section 12, a turbine section 18 coupled downstream from the combustor section 16, and an exhaust section 20. Turbine section 18 is rotatably coupled to compressor section 14 and to a load 22 such as, but not limited to, an electrical generator and a mechanical drive application.

During operation, intake section 12 channels air towards compressor section 14. The compressor section 14 compresses inlet air to higher pressures and temperatures. The compressed air is discharged towards to combustor section 16 wherein it is mixed with fuel and ignited to generate combustion gases that flow to turbine section 18, which drives compressor section 14 and/or load 22. Exhaust gases exit turbine section 18 and flow through exhaust section 20 to ambient atmosphere.

Figure 2:
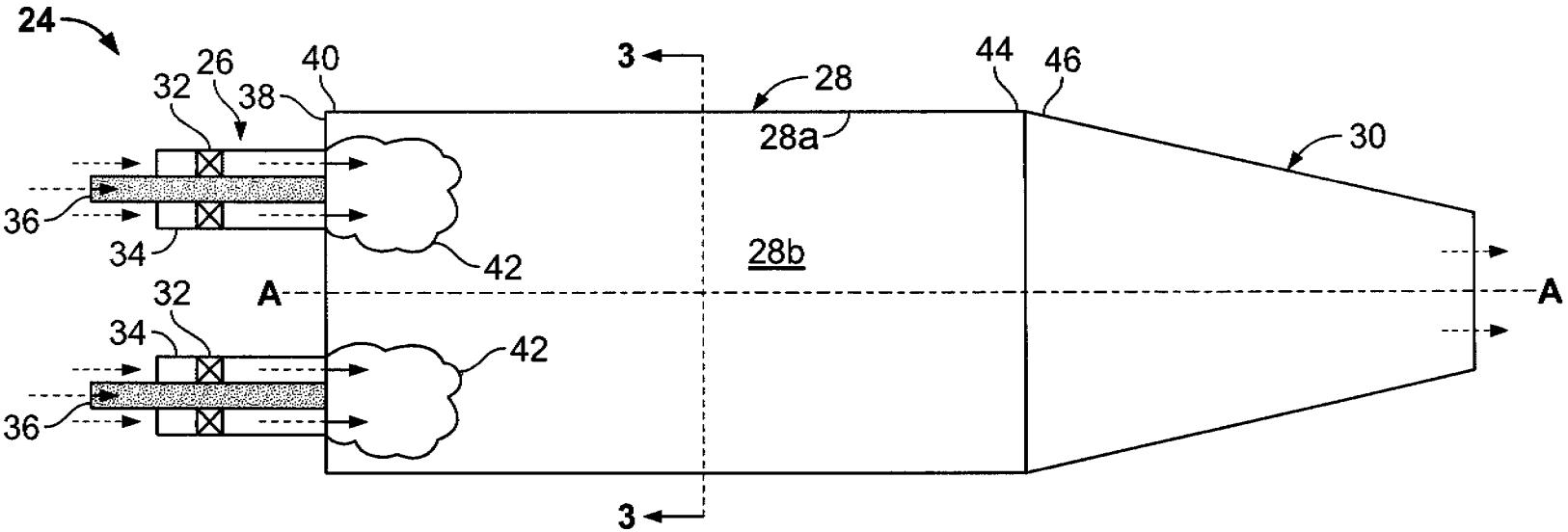
FIG. 2 (Prior Art)
FIG. 2 is a schematic illustration of an exemplary known Dry-Low $NO_x$ ("DLN") combustor that may be used with the combustion section shown in FIG. 1.
Figure 3:
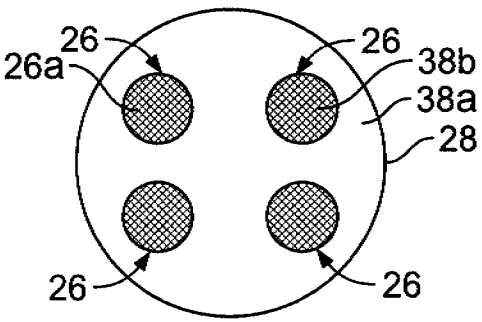
FIG. 3 (Prior Art)
FIG. 3 is a cross-sectional view of the known DLN combustor shown in FIG. 2 and taken along line 3-3.

FIG. 2 is a schematic illustration of an exemplary known Dry-Low $NO_x$ ("DLN") combustor 24 that includes a plurality of premixing injectors 26, a combustion liner 28 having a center axis A-A, and a transition piece 30. FIG. 3 is a cross-sectional view of DLN combustor 24 taken along line 3-3 (shown in FIG. 2). Each premixing injector 26 includes a plurality of annular swirl vanes 32 and fuel spokes (not shown) that are configured to premix compressed air and fuel entering through an annular inlet flow conditioner ("IFC") 34 and an annular fuel centerbody 36, respectively.

Known premixing injectors 26 are generally coupled to an end cap 38 of combustor 24, or are coupled near a first end 40 of combustion liner 28. In the exemplary embodiment, four premixing injectors 26 are coupled to end cap 38 and cap 38 includes a diffusion tip face 38*a*. End cap 38 defines a plurality of openings 38*b* that are in flow communication with diffusion tips 26*a* of premixing injectors 26. Liner first end 40 is coupled to end cap 38 such that combustion liner 28 may receive a fuel-air premixture injected from premixing injectors 26 and burn the mixture in local flame zones 42 defined within combustion chamber 28*b* defined by combustion liner 28. A second end 44 of combustion liner 28 is coupled to a first end 46 of transition piece 30. Transition piece 30 channels the combustion flow towards a turbine section, such as turbine section 18 (shown in FIG. 1) during operation.

Local areas of low velocity are known to be defined within combustion chamber 28*b* and along liner inner surfaces 28*a* of liner 28 during operation. For example, swirling air is channeled from premixing injectors 26 into a larger combustion liner 28 during operation. At the area of entry into combustion liner 28, swirling air is known to radially expand in combustion liner 28. The axial velocity at the center of liner 28 is reduced. Such combustor local areas of low velocity may be below the flame speed for a given fuel/air mixture. As such, pilot flames in such areas may flashback towards areas of desirable fuel-air concentrations as far upstream as the low velocity zone will allow, such as, but not limited to, areas within premixing injectors 26. As a result of flashback, premixing injectors 26 and/or other combustor components may be damaged and/or the operability of combustor 24 may be compromised.

Sufficient variation in premix fuel/air concentration in combustion liner 28 may also result in combustion instabilities resulting in flashback into premixing injectors 26 and/or in higher dynamics as compared to a more uniform premix fuel/air concentration. Also, local areas of less uniform fuel and air mixture within combustor 24 may also exist where combustion can occur at near stoichiometric temperatures in which $NO_x$ may be formed.

Figure 4:
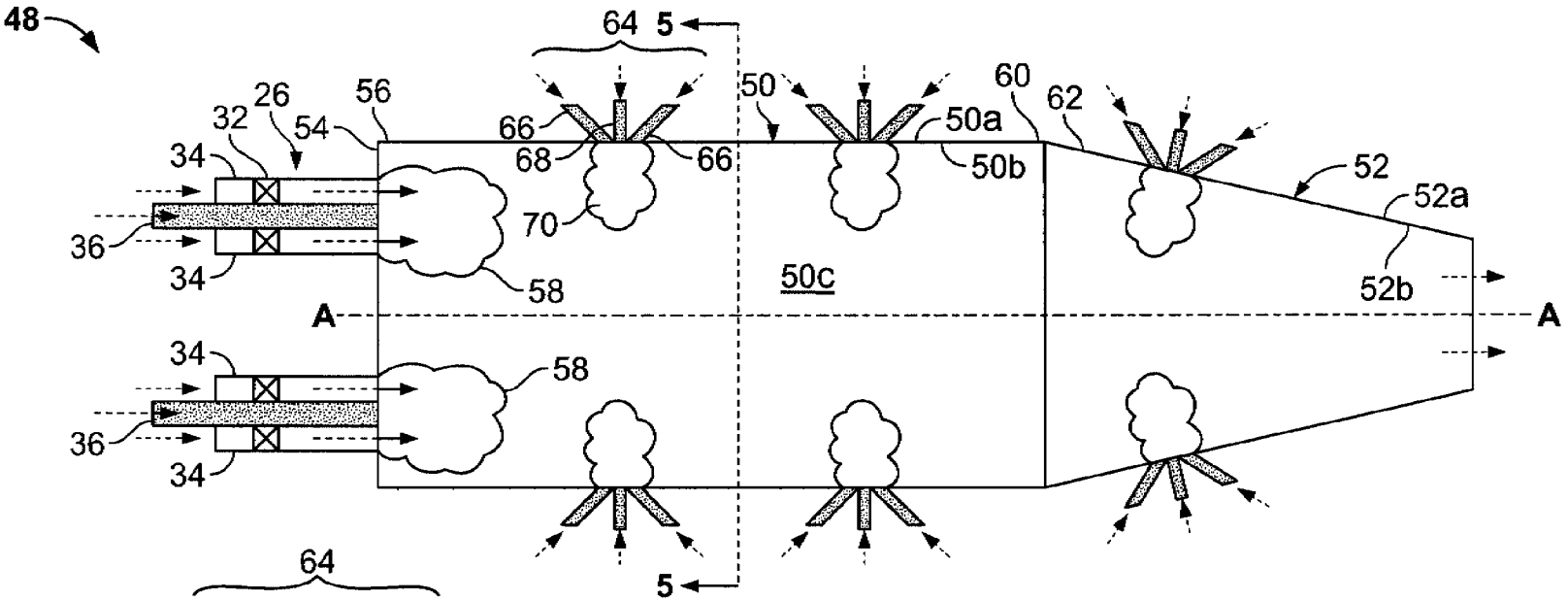
FIG. 4 is a schematic illustration of an exemplary DLN combustor that may be used with the turbine combustion section shown in FIG. 1.
Figure 5:
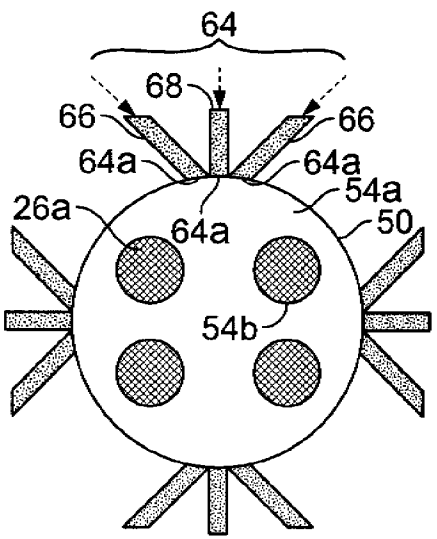
FIG. 5 is a cross-sectional view of the DLN combustor shown in FIG. 4 and taken along line 5-5.

FIG. 4 is a schematic illustration of an exemplary Dry-Low $NO_x$ ("DLN") combustor 48 that may be used with gas turbine system 10 (shown in FIG. 1). FIG. 5 is a cross-sectional view of combustor 48 taken along line 5-5 (shown in FIG. 4). In the exemplary embodiment, combustor 48 includes a plurality of premixing injectors 26, a combustion liner 50 having a center axis A-A, and a transition piece 52. Each premixing injector 26 includes swirler vanes 32 and fuel spokes (not shown) that facilitate premixing compressed air and fuel channeled through IFC 34 and centerbody 36, respectively.

In the exemplary embodiment, premixing injectors 26 are coupled to an end cap 54 of combustor 48. More specifically, in the exemplary embodiment, four premixing injectors 26 are coupled to end cap 54 and cap 54 includes a diffusion tip face 54*a*. End cap 54 also includes a plurality of injection holes 54*b* which are in flow communication with diffusion tips 26*a* of premixing injectors 26. It should be appreciated that premixing injectors 26 may be coupled to a first end 56 of combustion liner 50. In the exemplary embodiment, first end 56 is coupled to end cap 54 to facilitate combustion in local premixed flame zones 58 within combustion chamber 58*c* during operation. A second end 60 of combustion liner 50 is coupled to a first end 62 of transition piece 52. Transition piece 52 channels combustion gases towards a turbine section such as turbine section 18 (shown in FIG. 1) during engine operation.

In the exemplary embodiment, combustor 48 also includes a plurality of axially-staged lean-direct injectors ("LDIs") 64 that are coupled along both combustion liner 50 and transition piece 52. It should be appreciated that LDIs 64 may be coupled along either combustion liner 50 and/or along transition piece 52. In the exemplary embodiment, combustion liner 50 defines a plurality of openings (not shown) that are in flow communication with diffusion tips 64*a* of a respective LDI 64. It should be appreciated that each LDI 64 may be formed as a cluster of orifices defined through outer surfaces 50*a* and 52*a* and inner surface 50*b* and 52*b* of combustion liner 50 and/or transition piece 52, respectively.

Each LDI 64 includes a plurality of air injectors 66 and corresponding fuel injectors 68. It should be appreciated that each LDI 64 may include any number of air and fuel injectors 66 and 68 that are oriented to enable direct injection of air and direct injection of fuel, such that a desired fuel-air mixture is formed within combustion liner 50 and/or transition piece 52. It should also be appreciated that air injectors 66 also enable injection of diluent or air with fuel for partial premixing, or air with fuel and diluent. It should also be appreciated that fuel injectors 68 also enable injection of diluent or fuel with air for partial premixing, or fuel with air and diluent. Although injectors 66 and 68 are illustrated as separate injectors, it should also be appreciated that air and fuel injectors 66 and 68 of a respective LDI 64 may be coaxially aligned to facilitate the mixing of air and fuel flows after injection into combustion liner 50 and/or transition piece 52. Moreover, it should be appreciated that any number of LDIs 64 may be coupled to combustion liner 50 and/or transition piece 52. Further, it should be appreciated that each LDI 64 may be controlled independently from and/or controlled with any number of other LDIs 62 to facilitate performance optimization.

When fully assembled, in the exemplary embodiment, each LDI 64 includes air injectors 66 that are orientated with respect to fuel injector 68 at an angle of between approximately 0 and approximately 90 or, more preferably, between approximately 30 to approximately 45, and all subranges therebetween. It should be appreciated that that each LDI 64 may include fuel injectors 68 that are orientated with respect to air injectors 66 at any angle that enables combustor 48 to function as described herein. It should also be appreciated that the injector orientation, the number of injectors 66, and the location of the injectors 66 may vary depending on the combustor and intended purpose.

Air and fuel injection holes (not shown) corresponding to LDI air and fuel injectors 66 and 68, respectively, are smaller than injection holes 54*b* used to inject fuel-air premixtures into combustion liner 50. As a result, flow from air and fuel injectors 66 and 68 facilitates enabling air and fuel to mix more rapidly within combustion liner 50 and/or transition piece 52 as compared to combustors using non-impinging air and fuel flows. More specifically, the resultant flow of air and fuel injected by each LDI 64 is directed towards a respective local flame zone 70 to facilitate stabilizing lean premixed turbulent flames defined in local premixed flame zones 58. It should be appreciated that any number of LDIs 64, air and fuel injectors 66 and 68, and/or air and fuel injection holes (not shown) of various sizes and/or shapes may be coupled to, or defined within combustion liner 50, transition piece 52, and/or end cap 54 to enable a desirable volume of air and fuel to be channeled towards specified sections and/or zones defined within combustor 48. It should also be appreciated that such sizes may vary depending on an axial location with respect to center axis A-A in which the combustor components are coupled to and/or defined.

In the exemplary embodiment, combustor 48 orients premixing injectors 26 and axially-staged LDIs 64 to facilitate increasing combustor 48 stabilization and reducing $NO_x$ emissions. As discussed above, LDIs 64 are spaced along combustion liner 50 and/or transition piece 52 to generate local flame zones 70 defined within combustion chamber 50*c* during operation. Such local flame zones 70 may define stable combustion zones as compared to local premixed flame zones 58. As such, LDIs 64 that are coupled adjacent to premixing injectors 26 may be used to facilitate stabilizing lean premixed turbulent flames, reducing dynamics, reducing flashback, reducing lean blowout ("LBO") margins, and increasing combustor 48 operability. Further, LDIs 64 facilitate the burnout of carbon monoxide ("CO") and unburned hydrocarbons of fuel-air premixtures along inner surfaces 50*b* and 52*b* of combustion liner 50 and transition piece 52, respectively. As such, LDI 64 also facilitates a reduction in carbon monoxide ("CO") emissions. This could facilitate increasing emissions compliant turndown capability and/or could allow for a shorter residence time combustor to reduce thermal $NO_x$.

In the exemplary embodiment, LDIs 64 inject air and fuel directly into combustion liner 50 and/or transition piece 52 prior to mixing. As a result, local flame zones 70 are formed that use shorter residence times as compared to the longer residence times of the premixing injectors 26. As such, axially staging LDIs 64 facilitates reducing overall combustion temperatures and reducing overall $NO_x$ emissions as compared to known DLN combustors.

During various operating conditions, combustor 48 facilitates increasing fuel flexibility by varying fuel splits between premixing injectors 26 and/or axially staged LDIs 64, and sizing air and fuel injectors 66 and 68 for different fuel types. For example, during start-up, acceleration, transfer, and/or part load operating conditions, fuel and air flow through premixing injectors 26 and LDIs 64 may be distributed to facilitate flame stabilization and CO burnout of lean premixed flames in local premixed flame zones 58. During full load operating conditions, fuel and air flow through premixing injectors 26 and LDIs 64 may be distributed to facilitate reducing a residence time of high temp combustion products in combustor 48. For example, combustor 48 facilitates implementing shorter term, higher power operations for applications such as grid compliance. Because a large number of LDI 64 clusters are axially distributed, air and/or fuel flow to respective injectors 66 and 68 may be adjusted according to various operating conditions. It should be appreciated that LDIs 64 along liner surfaces 50 also could be used in conjunction with surface ignitors for ignition/relight to facilitate reduction of cross fire tubes.

By combining premixing injectors 26 and axially-staged LDIs, 64, combustor 48 facilitates controlling turndown and/or combustor dynamics. Combustor 48 also facilitates reducing overall $NO_x$ emissions. As a result, in comparison to known combustors, combustor 48 facilitates increasing the efficiency and operability of a turbine containing such systems.

Figure 6:
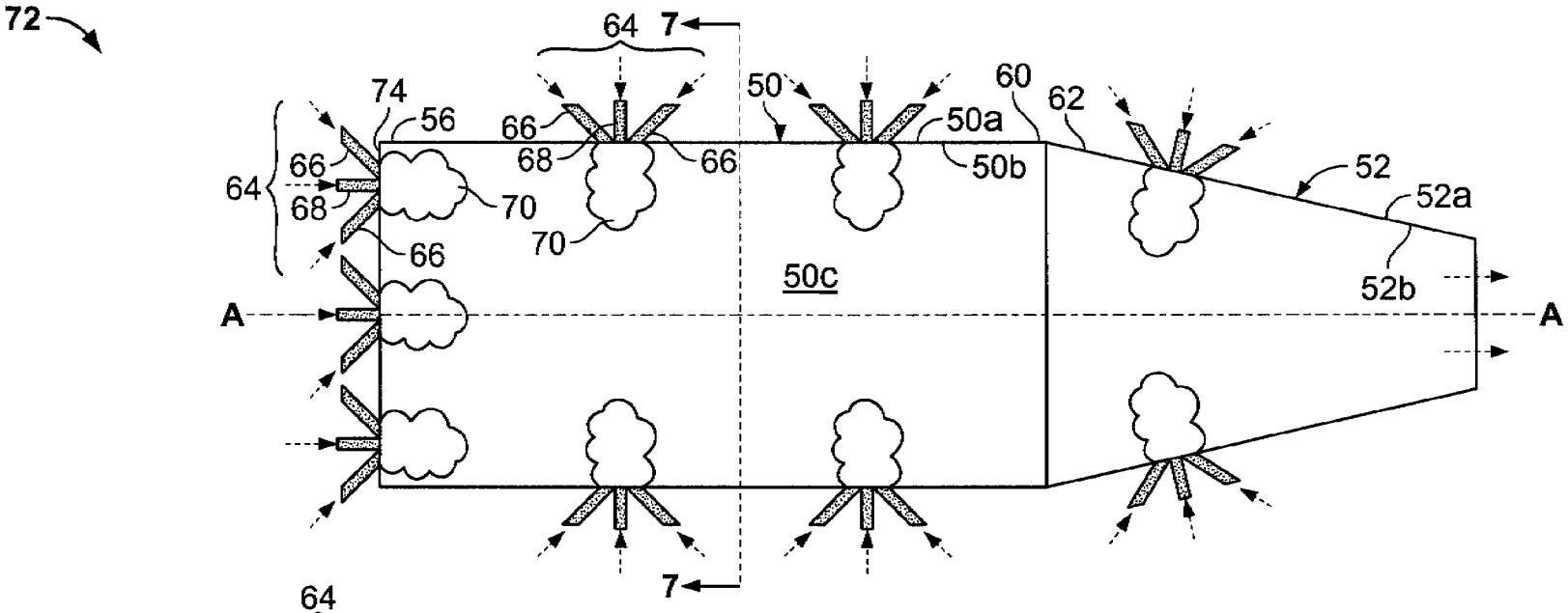
FIG. 6 is a schematic illustration of an alternative embodiment of a DLN combustor that may be used with the turbine combustion section shown in FIG. 1.
Figure 7:
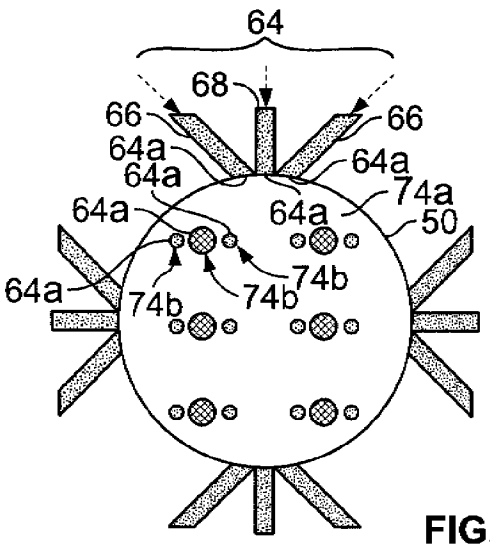
FIG. 7 is a cross-sectional view of the DLN combustor shown in FIG. 6 taken along line 6-6.

FIG. 6 is a schematic illustration of an alternative Direct-Low NOx ("DLN") combustor 72 that may be used with gas turbine system 10 (shown in FIG. 1). FIG. 7 is a cross-sectional view of DLN combustor 72 (shown in FIG. 6) taken along line 7-7. Combustor 72 is substantially similar to combustor 48 (shown in FIGS. 4 and 5), and components in FIGS. 6 and 7 that are identical to components of FIGS. 4 and 5, are identified in FIGS. 6 and 7 using the same reference numerals used in FIGS. 4 and 5.

In the exemplary embodiment, combustor 72 includes a combustion liner 50, transition piece 52, and a plurality of lean-direct injectors ("LDIs") 64. More specifically, in the exemplary embodiment, six LDIs 64 are coupled to end cap 74 and end cap 74 includes diffusion tip face 74*a*. It should be appreciated that any number of LDIs 64 may be coupled to combustion liner 50 and/or transition piece 52. End cap 74 also includes a plurality of injection holes 54*c* which are in flow communication with diffusion tips 64*a* of respective LDIs 64. In the exemplary embodiment, combustor 72 also includes a plurality of axially-staged LDIs 64 that are coupled along both combustion liner 50 and/or along transition piece 52. Combustion liner 50 defines a plurality of openings (not shown) that are in flow communication with diffusion tips 64*a* of a respective LDI 64. It should be appreciated that each LDI 64 may be formed as a cluster of orifices defined within end cap 54, combustion liner 50, and/or transition piece 52.

Each LDI 64 includes a plurality of air injectors 66 and a corresponding fuel injector 68. It should be appreciated that each LDI 64 may include any number of air and fuel injectors 66 and 68 that are oriented to enable direct injection of air and direct injection of fuel, such that a desired fuel-air mixture is formed within combustion liner 50 and/or transition piece 52. Although injectors 66 and 68 are illustrated as separate injectors, it should also be appreciated that air and fuel injectors 66 and 68 of a respective LDI 64 may be coaxially aligned to facilitate the mixing of air and fuel flows after injection into combustion liner 50 and/or transition piece 52. Further, it should be appreciated that any number of LDIs 64 may be coupled to combustion liner 50 and/or transition piece 52.

When fully assembled, in the exemplary embodiment, each LDI 64 includes air injectors 66 that are orientated with respect to fuel injector 68 at an angle of between approximately 0 and approximately 90 degrees or, more preferably, between approximately 30 to approximately 45 degrees, and all subranges therebetween. It should be appreciated that that each LDI 64 may include fuel injectors 68 that are orientated with respect to air injectors 66 at any angle that enables combustor 72 to function as described herein. It should also be appreciated that the injector orientation, the number of injectors 66, and the location of the injection holes may vary depending on the combustor and the intended purpose.

In the exemplary embodiment, LDIs 64 are associated with a plurality of air and fuel injection holes 74*b* orientated to channel air and fuel from air and fuel injectors 66 and 68 such that air and fuel impinge within combustion liner 50 and/or transition piece 52. As a result, flow from air and fuel injectors 66 and 68 facilitates enabling air and fuel to mix more rapidly within combustion liner 50 and/or transition piece 52 as compared to combustors using non-impinging air and fuel flows. More specifically, the resultant flow of air and fuel injected by each LDI 64 is directed towards a respective local flame zone 70 to facilitate stabilizing lean premixed turbulent flames defined in local premix flame zones 70. Further, LDIs 64 facilitate reducing lean blowout ("LBO") margins and increasing combustor 72 operability.

In the exemplary embodiment, LDIs 64 inject air and fuel directly into combustion liner 50 and/or transition piece 52 prior to mixing. As a result, local flame zones 70 are formed that use shorter residence times as compared to the longer residence times of known combustors. As such, axially staging LDIs 64 facilitates reducing overall combustion temperatures and reducing overall $NO_x$ emissions as compared to known DLN combustors.

During various operating conditions, combustor 72 facilitates increasing fuel flexibility by varying fuel splits between axially staged LDIs 64, and sizing air and fuel injectors 66 and 68 for different fuel types. Combustor 72 also facilitates controlling turndown and/or combustor dynamics. Further, combustor 72 facilitates reducing overall NOx emissions. As a result, in comparison to known combustors, combustor 72 facilitates increasing the efficiency and operability of a turbine containing such systems.

Figure 8:
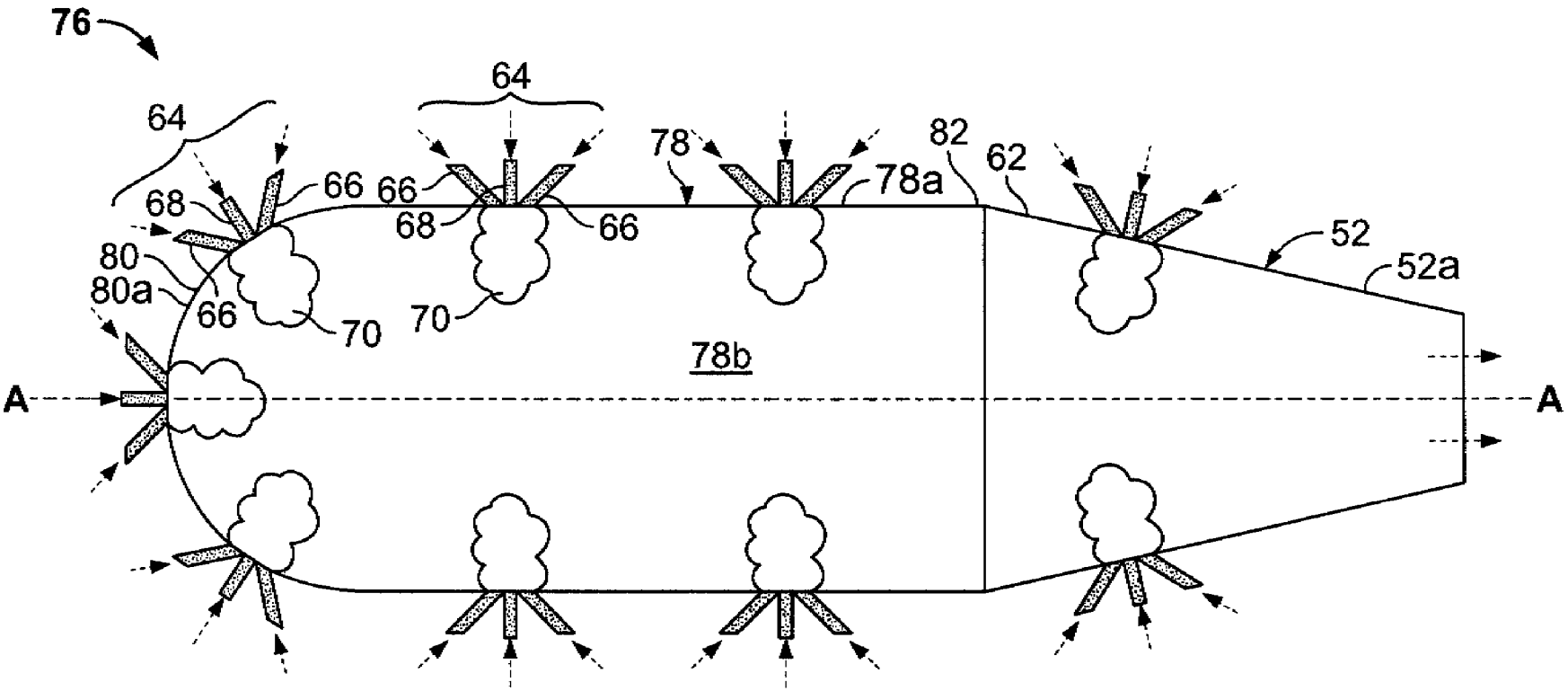
FIG. 8 is a schematic illustration of yet another alternative DLN combustor that may be used with the turbine combustion section shown in FIG. 1.

FIG. 8 is a schematic illustration of an alternative Dry-Low NOx ("DLN") combustor 76 that may be used with gas turbine system 10 (shown in FIG. 1). Combustor 76 is substantially similar to combustor 72 (shown in FIGS. 6 and 7), and components in FIG. 8 that are identical to components of FIGS. 6 and 7, are identified in FIG. 8 using the same reference numerals used in FIGS. 6 and 7.

In the exemplary embodiment, combustor 76 includes a combustion liner 78, transition piece 52, and lean-direct injectors ("LDIs") 64. Combustion liner 78 includes a first end 80 and a second end 82 that is coupled to first end 62 of transition piece 52. Although first end 80 is illustrated as having a substantially convex outer surface 80*a*, it should be appreciated that outer surface 80*a* may be any shape that enables combustor 76 to function as described herein.

In the exemplary embodiment, combustor 76 includes a plurality of axially-staged LDIs 64 that are coupled along both combustion liner 78 an/or along transition piece 52. Combustion liner 78 defines a plurality of openings (not shown) that are in flow communication with diffusion tips 64*a* of a respective LDI 64. It should be appreciated that each LDI 64 may be formed as a cluster of orifices defined through outer surfaces 78*a* and 52*a* and inner surfaces 78*b* and 52*b* of combustion liner 78 and/or transition piece 52, respectively.

Each LDI 64 includes air injectors 66 and corresponding fuel injector 68. It should be appreciated that each LDI 64 may include any number of air and fuel injectors 66 and 68 that are oriented to enable direct injection of air and direct injection of fuel, such that a desired fuel-air mixture is formed within combustion liner 78 and/or transition piece 52. Although injectors 66 and 68 are illustrated as separate injectors, it should also be appreciated that air and fuel injectors 66 and 68 of a respective LDI 64 may be coaxially aligned to facilitate the mixing of air and fuel flows after injection into combustion liner 78 and/or transition piece 52. Further, it should be appreciated that any number of LDIs 64 may be coupled to combustion liner 78 and/or transition piece 52.

When fully assembled, in the exemplary embodiment, each LDI 64 includes air injectors 66 that are orientated with respect to fuel injector 68 at an angle of between approximately 0 and approximately 90 degrees or, more preferably, between approximately 30 to approximately 45 degrees, and all subranges therebetween. It should be appreciated that that each LDI 64 may include fuel injectors 68 that are orientated with respect to air injectors 66 at any angle that enables combustor 76 to function as described herein. It should also be appreciated that the injector orientation, the number of injectors 66, and the location of injection holes may vary depending on the combustor and the intended purpose.

In the exemplary embodiment, LDIs 64 are associated with a plurality of air and fuel injection holes (not shown) orientated to channel air and fuel from air and fuel injectors 66 and 68 such that air and fuel impinge within combustion liner 78 and/or transition piece 52. As a result, flow from air and fuel injectors 66 and 68 facilitates enabling air and fuel to mix more rapidly within combustion liner 78 and/or transition piece 52 as compared to combustors using non-impinging air and fuel flows. More specifically, the resultant flow of air and fuel injected by each LDI 64 is directed towards local flame zones 70, which are defined within combustion chamber 78*b*, to facilitate stabilizing lean premixed turbulent flames defined in local premix flame zones 70. Further, LDIs 64 facilitate reducing lean blowout ("LBO") margins and increasing combustor 76 operability.

In the exemplary embodiment, LDIs 64 inject air and fuel directly into combustion liner 78 and/or transition piece 52 prior to mixing. As a result, local flame zones 70 are formed that use shorter residence times as compared to the longer residence times of known combustors. As such, axially staging LDIs 64 facilitates reducing overall combustion temperatures and reducing overall $NO_x$ emissions as compared to known DLN combustors.

During various operating conditions, combustor 76 facilitates increasing fuel flexibility by varying fuel splits between axially staged LDIs 64, and sizing air and fuel injectors 66 and 68 for different fuel types. Combustor 76 also facilitates controlling turndown and/or combustor dynamics. Further, combustor 76 facilitates reducing overall NOx emissions. As a result, in comparison to known combustors, combustor 76 facilitates increasing the efficiency and operability of a turbine containing such systems.

A method for assembling gas turbine combustor systems 48, 72, and 76 is provided. The method includes providing combustion liners including center axis A-A, outer wall, a first end, and a second end. The outer wall is orientated substantially parallel to the center axis. The method also includes coupling a transition piece to the liner second end. The transition piece includes an outer wall. The method further includes coupling a plurality of lean-direct injectors along at least one of the liner outer wall and the transition piece outer wall such that the injectors are spaced axially apart along the wall.

In each exemplary embodiment, a plurality of axially-staged lean-direct injectors and fuel injectors are coupled to, or defined within, the walls of a combustion liner and/or transition piece. As a result, the combustors described herein facilitate distributing direct fuel and air throughout the combustor. The enhanced distribution of fuel and air facilitates stabilizing pilot flames, reducing flashback, reducing lean blowout ("LBO") margins, increasing fuel flexibility, controlling combustor dynamics, implementing various load operating conditions, reducing $NO_x$ emissions, and/or enhancing combustor operability.

Exemplary embodiments of combustors are described in detail above. The combustors are not limited to use with the specified turbine containing systems described herein, but rather, the combustors can be utilized independently and separately from other turbine containing system components described herein. Moreover, the invention is not limited to the embodiments of the combustors described in detail above. Rather, other variations of combustor embodiments may be utilized within the spirit and scope of the claims.

While the invention has been described in terms of various specific embodiments, those skilled in the art will recognize that the invention can be practiced with modification within the spirit and scope of the claims.

What is claimed is:

1. A method for assembling a gas turbine combustor system, said method comprising:

providing a combustion liner including a center axis, an outer wall, a first end, and a second end, wherein the outer wall orientated substantially parallel to the center axis and having a first end and a second end having substantially the same cross-sectional area;

coupling a transition piece to the liner second end, wherein the transition piece includes an outer wall having a first end with a first cross-sectional area and a second end with a second cross-sectional area such that the transition piece is substantially frustoconical in shape; and coupling a plurality of lean-direct injectors along the liner outer wall and the transition piece outer wall such that the injectors are spaced axially apart along the liner outer wall and the transition piece outer wall.

2. A method in accordance with claim 1 further comprising coupling at least one premixing injector adjacent to the liner first end.

3. A method in accordance with claim 1 further comprising coupling at least one lean-direct injector adjacent to the liner first end.

4. A method in accordance with claim 1 further comprising coupling an end cap to the liner first end.

5. A method in accordance with claim 4 further comprising coupling at least one premixing injector to the end cap.

6. A method in accordance with claim 4 further comprising coupling at least one lean-direct injector to the end cap.

7. A method in accordance with claim 1 wherein each of the lean-direct injectors includes at least one air injector and at least one fuel injector, said method further comprises orientating each air injector and each fuel injector such that air and fuel flows discharged therefrom impinge within the combustion liner.

8. A method in accordance with claim 7 further comprising:

defining a plurality of openings in the liner outer wall and the transition piece outer wall; and orientating the openings to be in flow communication with the at least one air injector and the at least one fuel injector of a respective lean-direct injector.

9. A method for distributing air and fuel in a gas turbine combustor system comprising:

providing a combustion liner including a center axis, an outer wall, a first end, and a second end, wherein the outer wall is orientated substantially parallel to the center axis and having a first end and a second end having substantially the same cross-sectional area;

coupling a transition piece to the liner second end, wherein the transition piece includes an outer wall having a first end with a first cross-sectional area and a second end with a second cross-sectional area such that the transition piece is substantially frustoconical in shape; and axially staging air and fuel injection through a plurality of lean-direct injectors spaced axially along the liner outer wall and the transition piece outer wall.

10. A method in accordance with claim 9 wherein axially staging air and fuel injection further comprises injecting air and fuel separately into the at least one liner outer wall and transition piece outer wall.

11. A method in accordance with claim 10 wherein axially staging air and fuel injection further comprises injecting air and fuel from a respective lean-direct injector based on an operating condition of the gas turbine system.

12. A gas turbine combustor system comprising:

a combustion liner comprising a center axis, an outer wall, a first end, and a second end, said outer wall is orientated substantially parallel to the center axis and having a first end and a second end having substantially the same cross-sectional area;

a transition piece coupled to said liner second end, said transition piece comprising an outer wall having a first end with a first cross-sectional area and a second end with a second cross-sectional area such that the transition piece is substantially frustoconical in shape; and a plurality of lean-direct injectors spaced axially along said liner outer wall and said transition piece outer wall.

13. A gas turbine combustor system in accordance with claim 12 further comprising at least one premixing injector coupled adjacent to said liner first end.

14. A gas turbine combustor system in accordance with claim 12 further comprising at least one lean-direct injector coupled adjacent said liner first end.

15. A gas turbine combustor system in accordance with claim 12 further comprising an end cap coupled to said liner first end.

16. A gas turbine combustor system in accordance with claim 15 further comprising at least one premixing injector coupled to said end cap.

17. A gas turbine combustor system in accordance with claim 15 further comprising at least one lean-direct injector coupled to said end cap.

18. A gas turbine combustor system in accordance with claim 12 wherein each of said lean-direct injectors comprises:

at least one air injector configured to introduce air flow within said combustor liner; and at least one fuel injector configured to fuel within said combustion liner such that the fuel mixes with the air.

19. A gas turbine combustor system in accordance with claim 18 wherein said at least one air injector and said at least one fuel injector are orifices defined in at least one of said liner outer wall and said transition piece outer wall.

20. A gas turbine combustor system in accordance with claim 18 wherein at least one of said combustion liner and said transition piece comprises a plurality of openings defined therein, said openings are in flow communication with said at least one air injector and said at least one fuel injector.

* * * * *